US008772660B2

(12) United States Patent
Liang et al.

(10) Patent No.: US 8,772,660 B2
(45) Date of Patent: Jul. 8, 2014

(54) INPUT DEVICE WITH SWING OPERATION

(75) Inventors: Chen-Yi Liang, New Taipei (TW); Cheng-Hsiang Chuang, New Taipei (TW); Chun-Chien Chen, New Taipei (TW); Shun-De Bai, New Taipei (TW); San-Pao Kao, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 293 days.

(21) Appl. No.: 13/327,772

(22) Filed: Dec. 16, 2011

(65) Prior Publication Data

US 2012/0194417 A1 Aug. 2, 2012

(30) Foreign Application Priority Data

Jan. 28, 2011 (TW) ..... 100202060 U

(51) Int. Cl.
*H01H 13/70* (2006.01)

(52) U.S. Cl.
USPC ..... 200/345; 200/344; 200/341

(58) Field of Classification Search
CPC ..... H01H 13/70
USPC ..... 200/341–345; 400/490, 495
See application file for complete search history.

(56) References Cited

U.S. PATENT DOCUMENTS 4,482,791 A * 11/1984 Rendgen ..... 200/343
5,466,901 A * 11/1995 Mochizuki ..... 200/5 A
6,150,624 A * 11/2000 Yao ..... 200/344

* cited by examiner

*Primary Examiner* — Renee S Luebke
*Assistant Examiner* — Ahmed Saeed
(74) *Attorney, Agent, or Firm* — Winston Hsu; Scott Margo

(57) ABSTRACT

An input device with swing operation includes a supporting frame, a flexible printed circuit installed on the supporting frame for outputting a signal, a supporting base fixed on the supporting frame, a cap pivoted to the supporting base, and a hook respectively pivoted to the supporting base and the cap. An inclined angle is formed between the hook and the supporting frame when the cap is not pressed down. The hook and the cap pivots relative to the supporting base when the cap is pressed down. The input device further includes a resilient component disposed between the flexible printed circuit and the cap for being pressed by the cap to actuate the flexible printed circuit when the cap is pressed down.

10 Claims, 9 Drawing Sheets

INPUT DEVICE WITH SWING OPERATION

BACKGROUND OF THE INVENTION

1. Field of the Invention

The present invention relates to an input device, and more particularly, to an input device with swing operation for reducing total height thereof.

2. Description of the Prior Art

Generally, a conventional keyswitch of consumer electronic products utilizes a plurality of structural components with a resilient component to support a cap and rebound the cap. For example, it can utilize a scissors-type frame and a rubber dome for upright operation of the keyswitch to actuate a switch. However, upright operation needs more mechanical space for movement of the cap, so as to increase total height thereof. Besides, it has disadvantages of large amounts of components and complicated assembly. Thus, design of an input device capable of reducing occupied mechanical space and saving assembly cost is an important issue of the mechanical industry.

SUMMARY OF THE INVENTION

The present invention provides an input device with swing operation for reducing total height thereof for solving above drawbacks.

According to the claimed invention, an input device with swing operation includes a supporting frame, a flexible printed circuit installed on the supporting frame for outputting a signal, a supporting base fixed on the supporting frame, a cap pivoted to the supporting base, and a hook respectively pivoted to the supporting base and the cap. An inclined angle is formed between the hook and the supporting frame when the cap is not pressed down. The hook and the cap pivots relative to the supporting base when the cap is pressed down. The input device further includes a resilient component disposed between the flexible printed circuit and the cap for being pressed by the cap to actuate the flexible printed circuit when the cap is pressed down.

According to the claimed invention, a plurality of openings is formed on the supporting frame and located in positions corresponding to pivots of the hook, the supporting base and the cap, and corresponding to a pivot of the cap and the supporting base.

According to the claimed invention, the supporting base is fixed on the supporting frame in a hot melt manner.

According to the claimed invention, a notch is formed on the supporting base and located in a position corresponding to the resilient component.

According to the claimed invention, a slot is formed on the supporting base for pivoting an end of the hook, so that the end of the hook slides inside the slot when the cap is pressed down.

According to the claimed invention, a hole is further formed on the supporting base, connected to the slot and facing the cap, and the end of the hook passes through the hole to pivot inside the slot.

According to the claimed invention, a hole is further formed on the supporting base, connected to the slot and facing an opening of the supporting frame, and the end of the hook passes through the hole to pivot inside the slot.

According to the claimed invention, the supporting frame contacts against an end of the cap when the cap is pressed down.

According to the claimed invention, the resilient component is a rubber pillar.

According to the claimed invention, the input device is a keyswitch.

The input device of the present invention utilizes the hook to perform swing operation of the cap, instead of upright operation of conventional caps. It can reduce the moving height of the cap so that there is no need to reserve more space for movement of the cap to save an internal mechanical space. Furthermore, the input device utilizes fewer components and has easy assembly, for reducing manufacturing and assembly cost.

These and other objectives of the present invention will no doubt become obvious to those of ordinary skill in the art after reading the following detailed description of the embodiment that is illustrated in the various figures and drawings.

DETAILED DESCRIPTION

Figure 1:
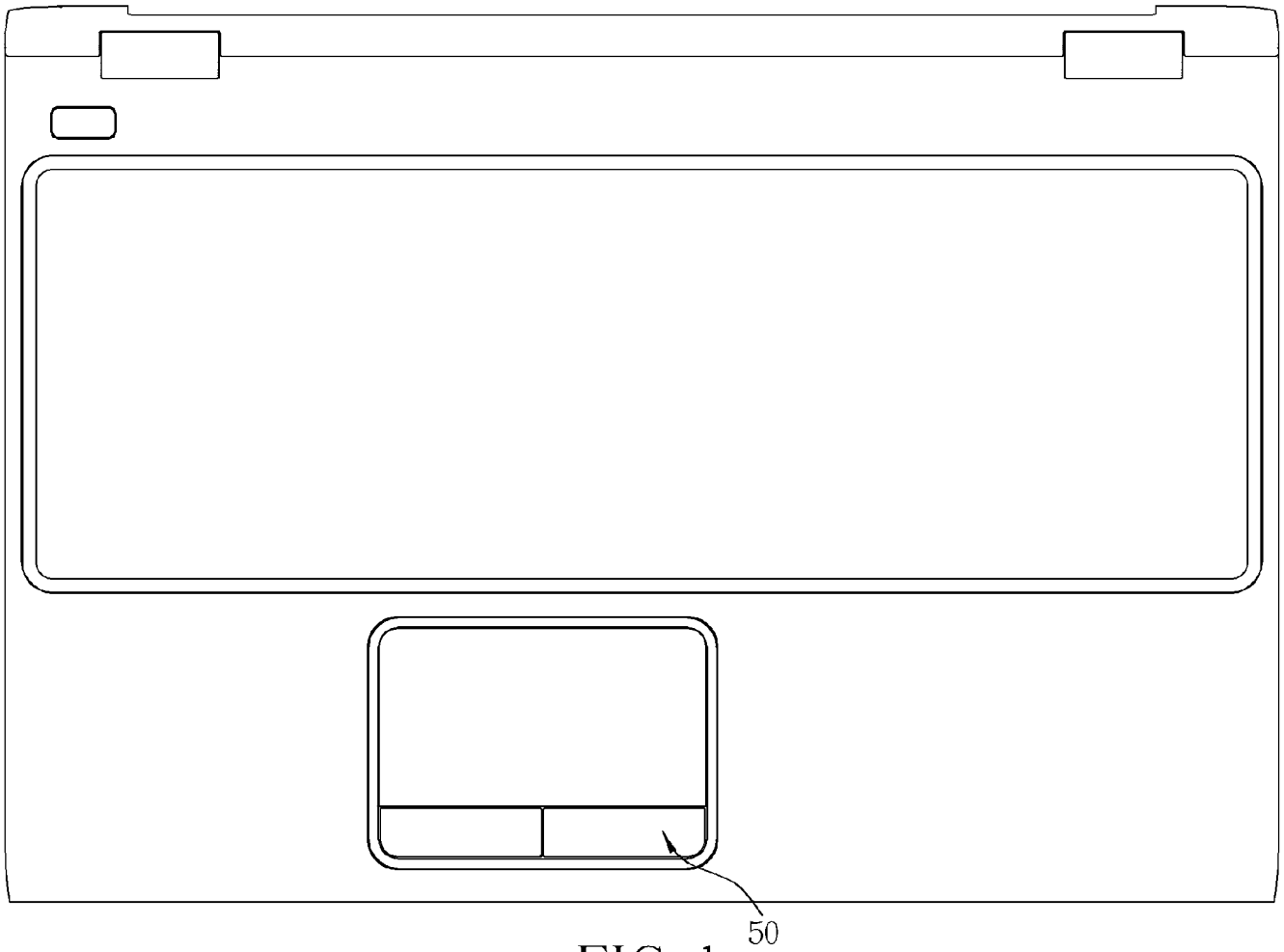
FIG. 1 is a schematic drawing of an input device according to an embodiment of the present invention.
Figure 2:
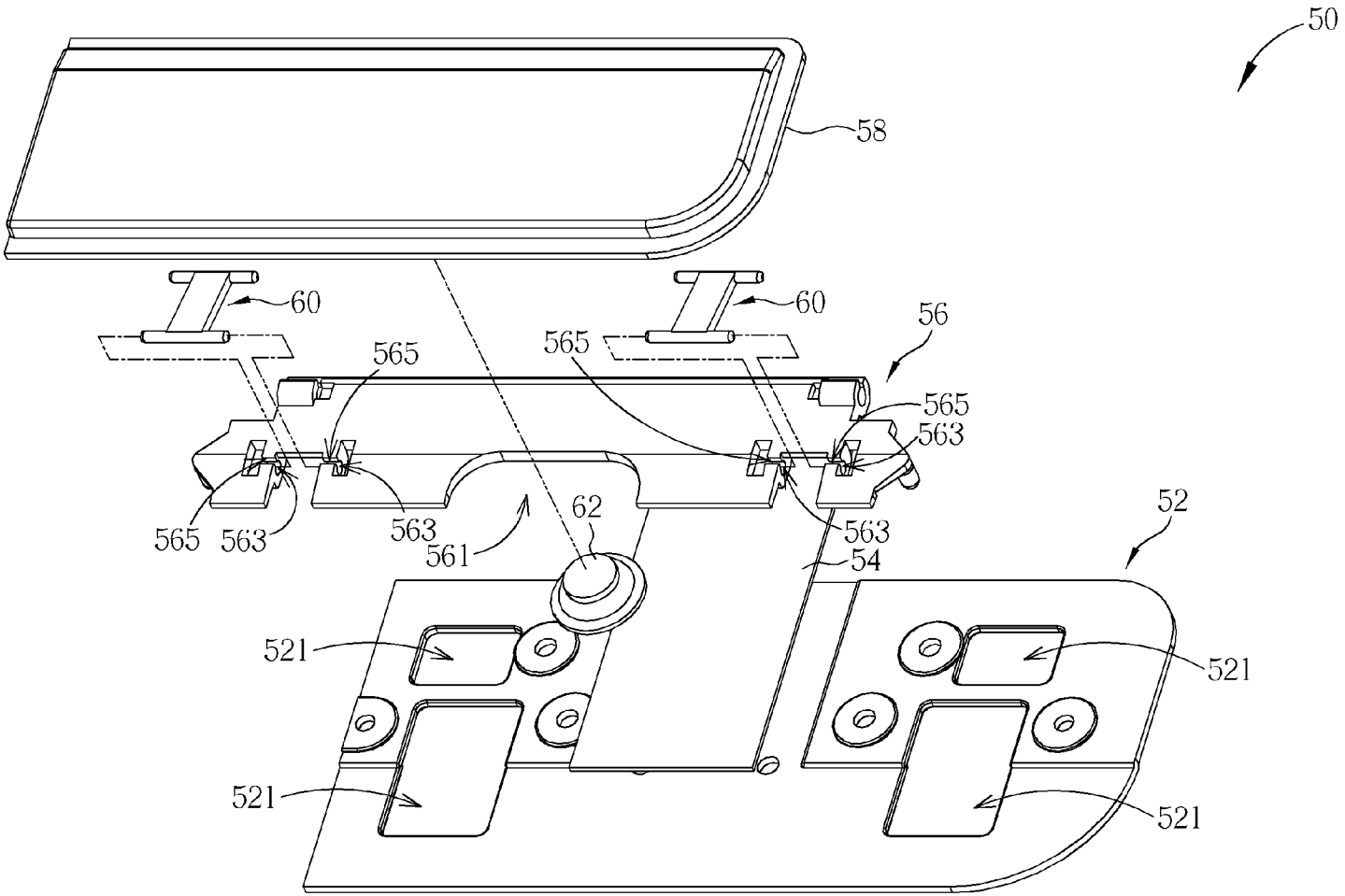
FIG. 2 and FIG. 3 are exploded diagrams of the input device in different views according to the embodiment of the present invention.
Figure 3:
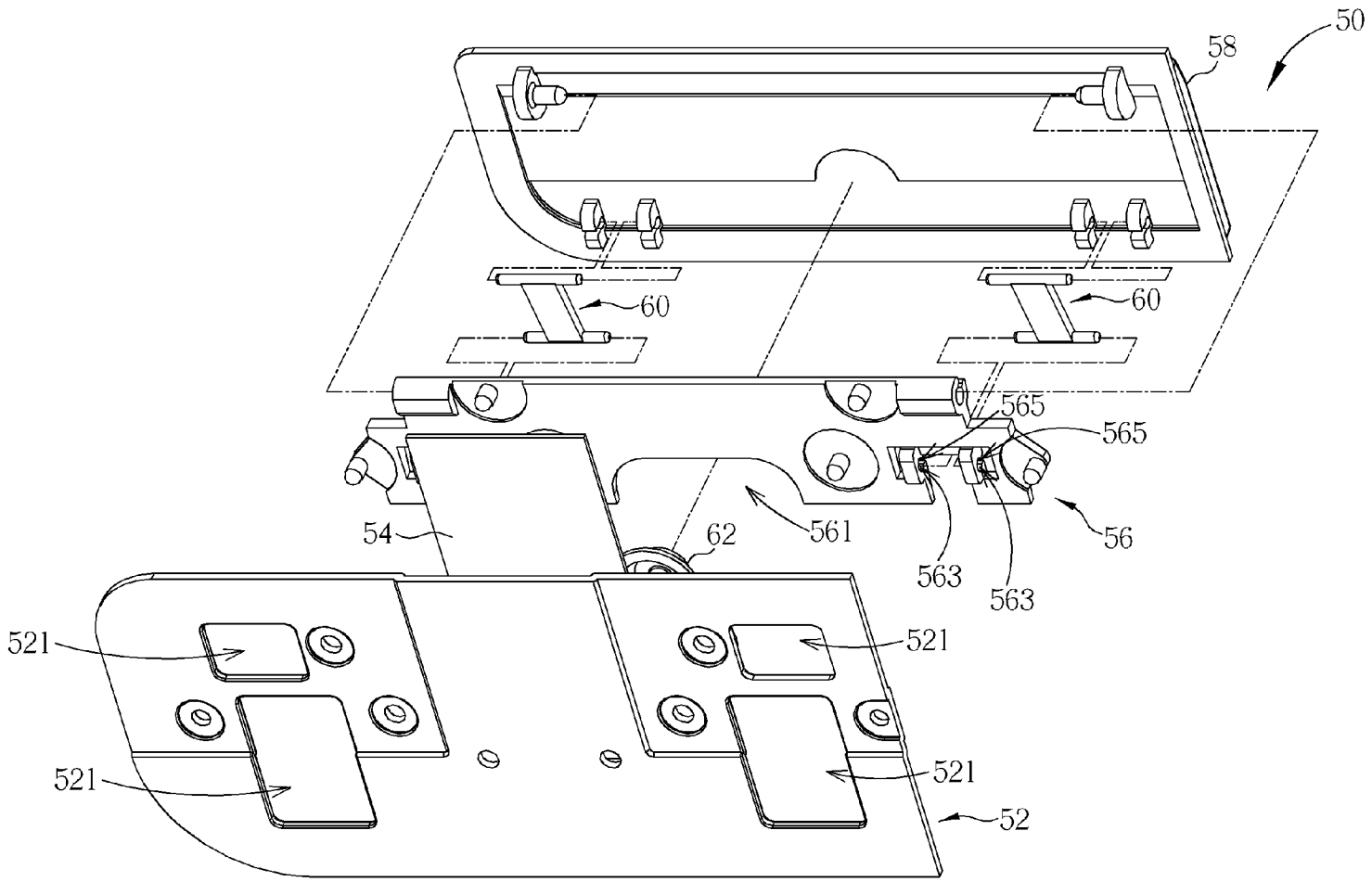

Please refer to FIG. 1 to FIG. 3. FIG. 1 is a schematic drawing of an input device 50 according to an embodiment of the present invention. FIG. 2 and FIG. 3 are exploded diagrams of the input device 50 in different views according to the embodiment of the present invention. The input device 50 can be a keyswitch, such as a keyswitch disposed below a touchpad of a notebook. The input device 50 includes a supporting frame 52, which can be an iron supporting frame. A plurality of openings 521 is formed on the supporting frame 52. The input device further includes a flexible printed circuit 54 installed on the supporting frame 52 for outputting a signal to other circuit. The flexible printed circuit 54 can be a multi-layer circuit board, such as a double-layer circuit board. Different layers of the multi-layer circuit board can be conducted for outputting corresponding signals as a switch when a predetermined region of the flexible printed circuit 54 is pressed down. The input device 50 further includes a supporting base 56 fixed on the supporting frame 52. For example, the supporting base 56 can be fixed on the supporting frame 52 in a hot-melt manner. A notch 561 is formed on the supporting base 56. The input device 50 further includes a cap 58 pivoted to the supporting base 56, such as combination of a positioning rod sheathed with a sheath. The cap 58 can be an appearance structure, and a user can press the cap 58 to generate corresponding signals. The input device 50 further includes at least one hook 60. Two ends of the hook 60 are respectively pivoted to the supporting base 56 and the cap 58, such as being shafted to the supporting base 56 and the cap 58. The hook 60 is capable of constraining upward and downward rotation of the cap 58. The supporting base 56 is capable of constraining planar movement of the cap 58, so as to ensure the cap 58 rotating precisely and to constrain sliding movement of the hook 60. In this embodiment, the input device 50 includes the two hooks 60 respectively disposed on two sides of the supporting base 56 and the cap 58. The amount and disposal of the hooks 60 are not limited to this embodiment, and it depends on actual demand.

The input device 50 further includes a resilient component 62 disposed between the flexible printed circuit 54 and the cap 58 and located in a position corresponding to the notch 561 of the supporting base 56, so as to prevent interference with the supporting base 56. The resilient component 62 can be glued on the flexible printed circuit 54. The resilient component 62 can be pressed by the cap 58 to actuate the flexible printed circuit 54 for generating corresponding signals when the cap 58 is pressed down by the user. The resilient component 62 can be made of non-conductive material. Different layers of the flexible printed circuit 54 can be conducted when the predetermined region of the flexible printed circuit 54 is pressed down by the resilient component 62, and it does not need to utilize the resilient component 62 to be an electrically conducting medium. Furthermore, the resilient component 62 can be a rubber pillar for resiliently supporting the cap 58 and providing an operational feeling. The cap 58 presses the resilient component 62 so as to resiliently deform the resilient component 62 as the cap 58 is pressed down. The resilient component 62 resiliently recovers to its original position and provides a resilient force to the cap 58 for recovering the cap 58 back to an unpressed position as the cap 58 is released. In addition, the resilient component 62 can be integrated with the cap 58 monolithically, and it depends on actual demand.

Figure 4:
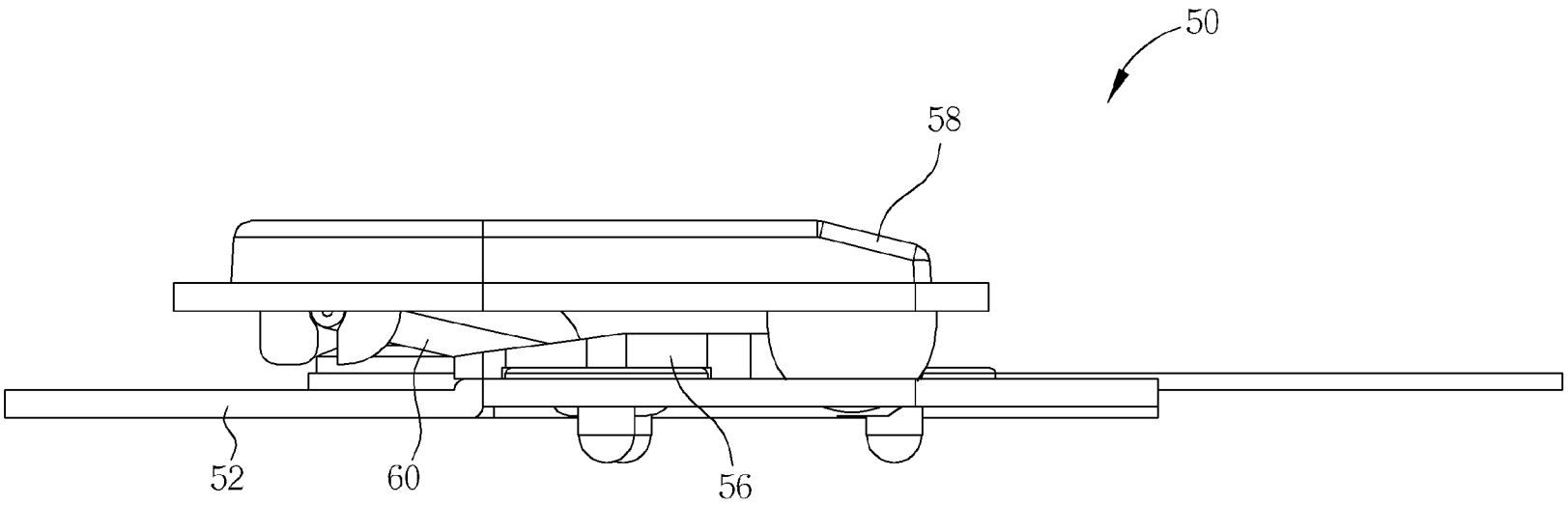
FIG. 4 and FIG. 5 are lateral diagrams respectively showing a cap being unpressed and pressed according to the embodiment of the present invention.
Figure 5:
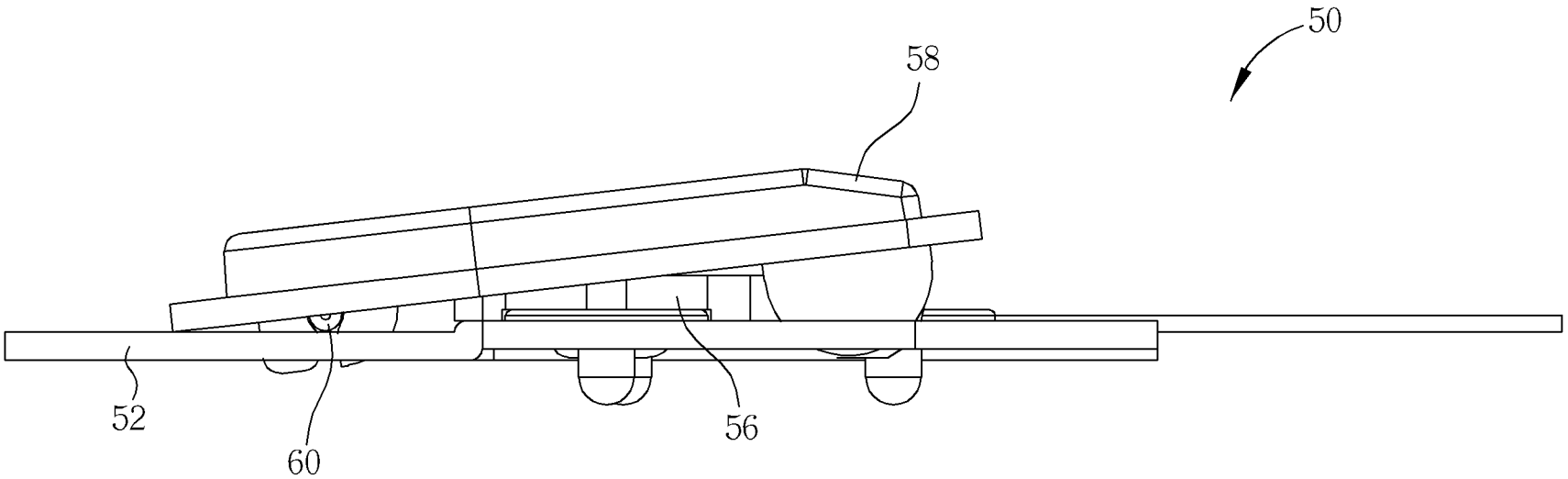
Figure 6:
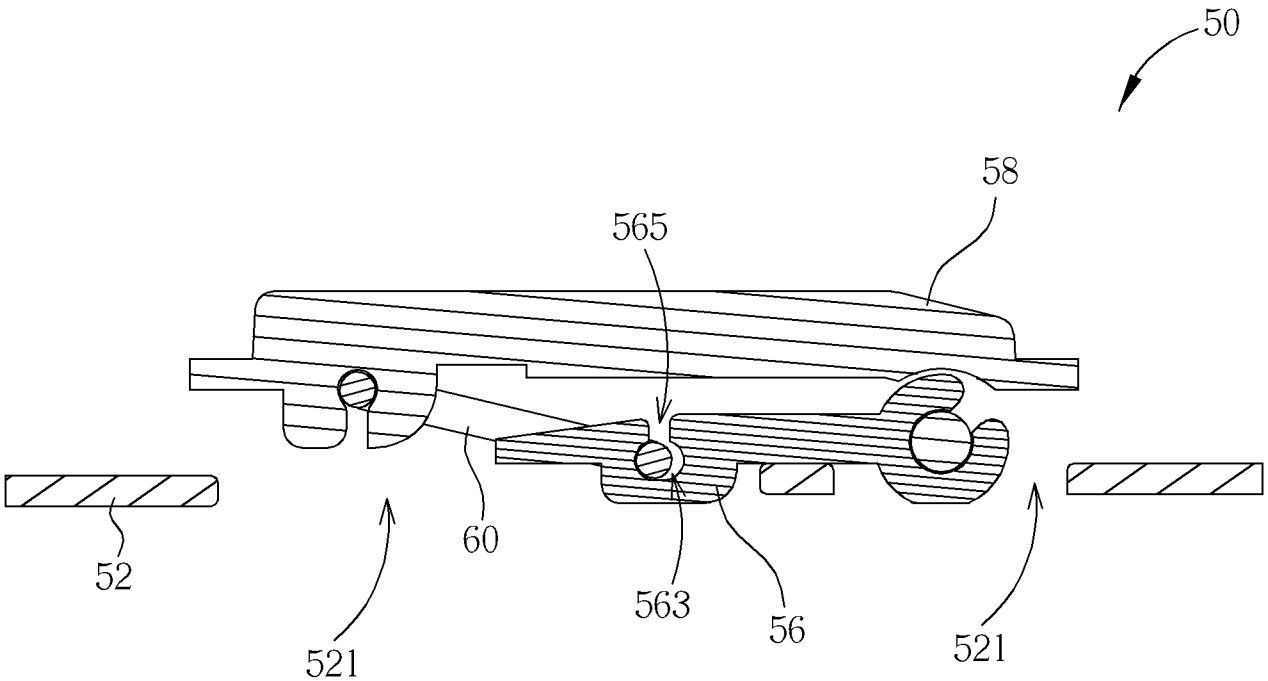
FIG. 6 and FIG. 7 are sectional diagrams respectively showing the cap being unpressed and pressed according to the embodiment of the present invention.
Figure 7:
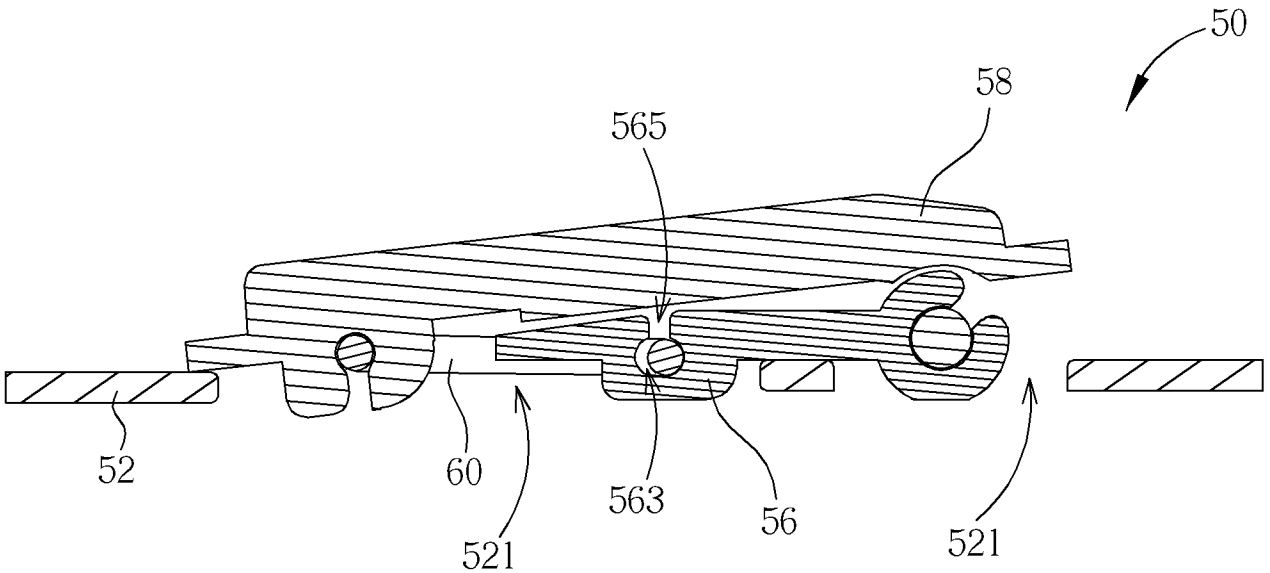

Please refer to FIG. 1 to FIG. 7. FIG. 4 and FIG. 5 are lateral diagrams respectively showing the cap 58 being unpressed and pressed according to the embodiment of the present invention. FIG. 6 and FIG. 7 are sectional diagrams respectively showing the cap 58 being unpressed and pressed according to the embodiment of the present invention. An inclined angle is formed between the hook 60 and the supporting frame 52 when the cap 58 is not pressed down. At this time, a resilient force provided by the resilient component 62 for pushing the cap 58 upwards, a pulling force provided by the hook 60 for pulling the cap 58 downwards, and gravity of the cap 58 are balanced, so that the cap 58 and the supporting frame 52 are substantially parallel to each other. The hook 60 and the cap 58 simultaneously pivot relative to the supporting base 56 when the cap 58 is pressed down by the user, until the supporting frame 52 contacts against an end of the cap 58. In summary, the present invention provides swing operation of the cap 58, instead of upright operation of conventional caps. Because the openings 521 of the supporting frame 52 are respectively located in positions corresponding to pivots of the hook 60, the supporting base 56 and the cap 58, and corresponding to a pivot of the cap 58 and the supporting base 56, the cap 58 and the hook 60 can pivot relative to the supporting base 56 without interference with the supporting frame 52. Furthermore, at least one slot 563 is formed on the supporting base 56 for pivoting an end of the hook 60. When the cap 58 is pressed down and the hook 60 pivots relative to the supporting base 56, the end of the hook 60 can slide inside the slot 563 backwards so that rotation of the cap 58 can be kept within the same plane, that is, the end of the cap 58 keeps moving in a straight line. At least one hole 565 is further formed on the supporting base 56, connected to the slot 563 and facing the cap 58. The end of the hook 60 passes through the hole 565 to pivot inside the slot 563, and the hook 60 is assembled on the supporting base 56 from an upper side of the supporting frame 56.

Figure 8:
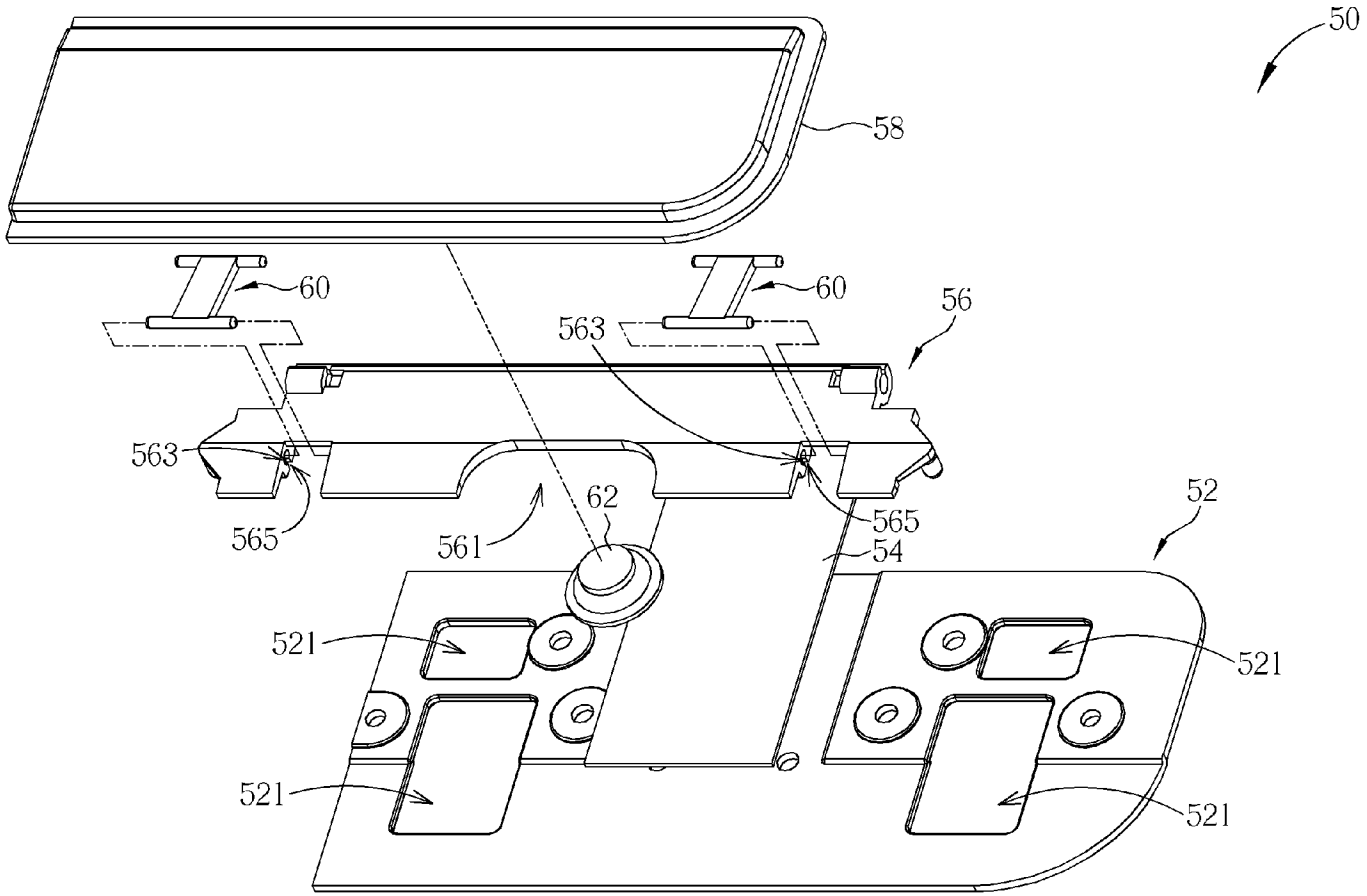
FIG. 8 and FIG. 9 are exploded diagrams of the input device in different views according to another embodiment of the present invention.
Figure 9:
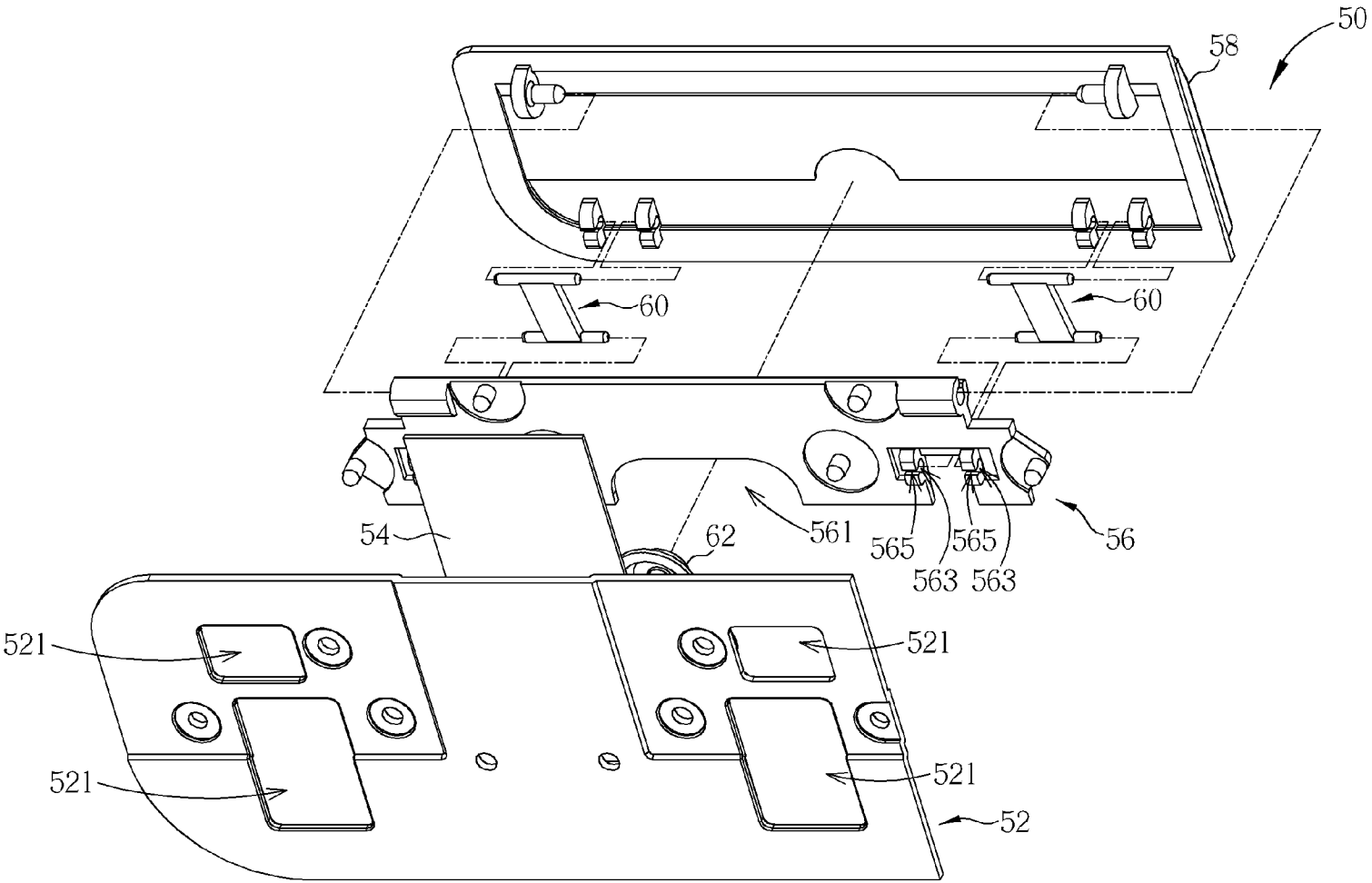

Please refer to FIG. 8 and FIG. 9. FIG. 8 and FIG. 9 are exploded diagrams of the input device 50 in different views according to another embodiment of the present invention. The difference between this embodiment and the previous embodiment is the position of the hole 565 of the supporting base 56. In this embodiment, the hole 565 is connected to the slot 563 and facing the opening 521 of the supporting frame 52. The end of the hook 60 also passes through the hole 565 to pivot inside the slot 563, and the hook 60 is assembled on the supporting base 56 from a bottom side of the supporting frame 56. The operational principle of other components is the same as the one in the previous embodiment, and detailed description is omitted herein for simplicity.

Comparing to the prior art, the input device of the present invention utilizes the hook to perform swing operation of the cap, instead of upright operation of conventional caps. It can reduce the moving height of the cap so that there is no need to reserve more space for movement of the cap to save an internal mechanical space. Furthermore, the input device utilizes fewer components and has easy assembly, for reducing manufacturing and assembly cost.

Those skilled in the art will readily observe that numerous modifications and alterations of the device and method may be made while retaining the teachings of the invention.

What is claimed is:

1. An input device comprising:

a supporting frame;

a flexible printed circuit installed on the supporting frame for outputting a signal;

a supporting base fixed on the supporting frame;

a cap pivoted to the supporting base;

a hook having two terminal ends, the two terminal ends respectively pivoted to the supporting base and the cap, an inclined angle being formed between the hook and the supporting frame when the cap is not pressed down, and the hook and the cap pivoting relative to the supporting base and the supporting frame when the cap is pressed down; and a resilient component disposed between the flexible printed circuit and the cap for being pressed by the cap to actuate the flexible printed circuit when the cap is pressed down.

2. The input device of claim 1, wherein a plurality of openings is formed on the supporting frame and located in positions corresponding to pivots of the hook, the supporting base and the cap, and corresponding to a pivot of the cap and the supporting base.

3. The input device of claim 1, wherein the supporting base is fixed on the supporting frame in a hot melt manner.

4. The input device of claim 1, wherein a notch is formed on the supporting base and located in a position corresponding to the resilient component.

5. The input device of claim 1, wherein a slot is formed on the supporting base for pivoting an end of the hook, so that the end of the hook slides inside the slot when the cap is pressed down.

6. The input device of claim 5, wherein a hole is further formed on the supporting base, connected to the slot and facing the cap, and the end of the hook passes through the hole to pivot inside the slot.

7. The input device of claim 5, wherein a hole is further formed on the supporting base, connected to the slot and facing an opening of the supporting frame, and the end of the hook passes through the hole to pivot inside the slot.

8. The input device of claim 1, wherein the supporting frame contacts against an end of the cap when the cap is pressed down.

9. The input device of claim 1, wherein the resilient component is a rubber pillar.

10. The input device of claim 1, being a keyswitch.

* * * * *